US010504438B2

(12) United States Patent
Bao et al.

(10) Patent No.: US 10,504,438 B2
(45) Date of Patent: Dec. 10, 2019

(54) PIXEL CIRCUIT AND DRIVING METHOD THEREOF, DISPLAY PANEL

(71) Applicant: BOE TECHNOLOGY GROUP CO., LTD., Beijing (CN)

(72) Inventors: Wenchao Bao, Beijing (CN); Guangcai Yuan, Beijing (CN)

(73) Assignee: BOE TECHNOLOGY GROUP CO., LTD., Beijing (CN)

( * ) Notice: Subject to any disclaimer, the term of this patent is extended or adjusted under 35 U.S.C. 154(b) by 100 days.

(21) Appl. No.: 15/540,775

(22) PCT Filed: Nov. 16, 2016

(86) PCT No.: PCT/CN2016/106120
§ 371 (c)(1),
(2) Date: Jun. 29, 2017

(87) PCT Pub. No.: WO2017/118221
PCT Pub. Date: Jul. 13, 2017

(65) Prior Publication Data

US 2018/0025690 A1 Jan. 25, 2018

(30) Foreign Application Priority Data

Jan. 4, 2016 (CN) ..... 2016 1 0004541

(51) Int. Cl.
*G09G 3/3258* (2016.01)
*G09G 3/3225* (2016.01)
(Continued)

(52) U.S. Cl.
CPC ..... *G09G 3/3258* (2013.01); *G09G 3/3225* (2013.01); *G09G 3/3233* (2013.01);
(Continued)

(58) Field of Classification Search
CPC combination set(s) only.
See application file for complete search history.

(56) References Cited

U.S. PATENT DOCUMENTS

2006/0012587 A1* 1/2006 Stevenson ..... G09G 3/3233 345/204
2017/0061878 A1* 3/2017 Park ..... G09G 3/3233

FOREIGN PATENT DOCUMENTS

CN 101937647 A 1/2011
CN 104050927 A 9/2014
(Continued)

OTHER PUBLICATIONS

International Search Report dated Jan. 25, 2017.
First Chinese Office Action dated Jun. 2, 2017.

*Primary Examiner* — Christopher E Leiby
(74) *Attorney, Agent, or Firm* — Dilworth & Barrese, LLP.; Michael J. Musella, Esq.

(57) ABSTRACT

A pixel circuit and a driving method thereof, and a display panel including the same. The pixel circuit includes, a first module and a second driving circuit, the first driving circuit drives the light emitting circuit to emit light during a first period under control of a first scanning signal at the first scanning control terminal, and the second driving circuit drives the light emitting circuit to emit light during a second period under control of a second scanning signal at the second scanning control terminal, the first and the second period not overlapping with each other. A light emitting device is alternately driven to emit light by using two driving circuits, so that one driving circuit enters a recovery stage while the other driving circuit drives the light emitting device to emit light, and thus threshold voltage drift of driving transistor can be reduced, while lifespan thereof can be prolonged.

20 Claims, 8 Drawing Sheets

(51) Int. Cl.
*G09G 3/3266* (2016.01)
*G09G 3/3233* (2016.01)

(52) U.S. Cl.
CPC ... *G09G 3/3266* (2013.01); *G09G 2300/0814* (2013.01); *G09G 2300/0823* (2013.01); *G09G 2300/0852* (2013.01); *G09G 2300/0861* (2013.01); *G09G 2310/0254* (2013.01); *G09G 2310/08* (2013.01); *G09G 2320/043* (2013.01); *G09G 2320/045* (2013.01); *G09G 2330/028* (2013.01)

(56) References Cited

FOREIGN PATENT DOCUMENTS

| | | | |
|---|---|---|---|
| CN | 203858846 | U | 10/2014 |
| CN | 104299573 | A | 1/2015 |
| CN | 204348301 | U | 5/2015 |
| CN | 105609047 | A | 5/2016 |
| CN | 103943067 | B | 4/2017 |
| WO | 2012101397 | A2 | 8/2012 |

* cited by examiner

PIXEL CIRCUIT AND DRIVING METHOD THEREOF, DISPLAY PANEL

TECHNICAL FIELD

The present disclosure relates to the display field, and more particularly to a pixel circuit and a driving method thereof, and a display panel.

BACKGROUND

Currently, in order to suppress the influence of the threshold voltage of the driving transistor in the pixel circuit of the organic light emitting diode display apparatus on the luminance of the organic light emitting diode, a threshold voltage compensation function has been realized in the pixel circuit, thereby compensating for the influence of the threshold voltage of the driving transistor on the luminance of the organic light emitting diode. For the whole organic light emitting diode display apparatus, the phenomenon of non-uniform luminance or flicking of the whole organic light emitting diode display apparatus, due to the nonuniformity and drifts of the threshold voltages of the driving transistors of respective pixels, may be reduced.

However, in the display process of the organic light emitting diode display apparatus, the gate-source voltage is continuously applied between the gate and the source of the driving transistor of each pixel, and thus the threshold voltage drift of the driving transistor of each pixel will increase continually. When this threshold voltage drift is in a certain extent, the threshold voltage drift may be compensated by the above mentioned threshold voltage compensation function. However, the above mentioned threshold voltage compensation function becomes inactive when this threshold voltage drift exceeds the certain extent, and accordingly, the display effect of the organic light emitting diode display apparatus is getting worse, thereby reducing the lifespan of the organic light emitting diode display apparatus.

Therefore, there is a need for a pixel circuit and a display panel capable of reducing the threshold voltage drift of the driving transistor of each driving circuit and prolonging the lifespan of the organic light emitting diode display apparatus.

SUMMARY

In view of the above, there is provided a pixel circuit and a driving method thereof, and a display panel including the pixel circuit, which alternately drives a light emitting device to emit light by using two driving circuits, so that one driving circuit enters a recovery stage while the other driving circuit drives the light emitting device to emit light, and thus the threshold voltage drift of the driving transistor in each driving circuit can be reduced.

According to an aspect of the present disclosure, it provides a pixel circuit, comprising a light emitting circuit, having a first terminal connected with a first terminal of a first driving circuit and a first terminal of a second driving circuit, a second terminal connected with a first power supply voltage terminal; the first driving circuit, having a second terminal connected with a first driving voltage terminal, a third terminal connected with a first scanning control terminal, a fourth terminal connected with a data input terminal, and configured to drive the light emitting circuit to emit light during a first period under control of a first scanning signal at the first scanning control terminal;

and the second driving circuit, having a second terminal connected with a second driving voltage terminal, a third terminal connected with a second scanning control terminal, a fourth terminal connected with the data input terminal, and configured to drive the light emitting circuit to emit light during a second period under control of a second scanning signal at the second scanning control terminal, the first period and the second period not overlapping with each other; wherein the first driving circuit and the second driving circuit are configured to alternately drive the light emitting circuit to emit light.

According to an embodiment of the present disclosure, during the first period in which the first driving circuit drives the light emitting circuit to emit light, the second driving circuit is configured to be in a recovery stage; and during the second period in which the second driving circuit drives the light emitting circuit to emit light, the first driving circuit is configured to be in the recovery stage.

According to an embodiment of the present disclosure, during odd-numbered frames, the first driving circuit reads a data signal at the data input terminal and drives the light emitting circuit to emit light according to the read data signal under control of the first scanning signal at the first scanning control terminal and a first driving voltage signal at the first driving voltage terminal, and the second driving circuit is reset and in the recovery stage; during even-numbered frames, the first driving circuit is reset and in the recovery stage, and the second driving circuit reads the data signal at the data input terminal and drives the light emitting circuit to emit light according to the read data signal under control of the second scanning signal at the second scanning control terminal and a second driving voltage signal at the second driving voltage terminal.

According to an embodiment of the present disclosure, the first driving circuit includes a first switching transistor, a first driving transistor and a first capacitor; a gate of the first switching transistor as the third terminal of the first driving circuit is connected with the first scanning control terminal, a first electrode of the first switching transistor as the fourth terminal of the first driving circuit is connected with the data input terminal, a second electrode of the first switching transistor is connected with a gate of the first driving transistor and a first terminal of the first capacitor; a first electrode of the first driving transistor as the second terminal of the first driving circuit is connected with the first driving voltage terminal, a second electrode of the first driving transistor as the first terminal of the first driving circuit is connected with the first terminal of the light emitting circuit and a second terminal of the first capacitor.

According to an embodiment of the present disclosure, the second driving circuit includes a second switching transistor, a second driving transistor and a second capacitor; a gate of the second switching transistor as the third terminal of the second driving circuit is connected with the second scanning control terminal, a first electrode of the second switching transistor as the fourth terminal of the second driving circuit is connected with the data input terminal, a second electrode of the second switching transistor is connected with a gate of the second driving transistor and a first terminal of the second capacitor; a first electrode of the second driving transistor as the second terminal of the second driving circuit is connected with the second driving voltage terminal, a second electrode of the second driving transistor as the first terminal of the second driving circuit is connected with the first terminal of the light emitting circuit and a second terminal of the second capacitor.

According to another aspect of the present disclosure, it also provides a driving method of the pixel circuit described above, comprising: during odd-numbered frames, under control of the first scanning signal at the first scanning control terminal, the first driving circuit reading a data signal at the data input terminal and driving the light emitting circuit to emit light according to the read data signal, and under control of the second scanning signal at the second scanning control terminal, the second driving circuit being reset and in a recovery stage; during even-numbered frames, under control of the second scanning signal at the second scanning control terminal, the second driving circuit reading the data signal at the data input terminal and driving the light emitting circuit to emit light according to the read data signal, and under control of the first scanning signal at the first scanning control terminal, the first driving circuit being reset and in a recovery stage.

According to an embodiment of the present disclosure, each frame is divided into a reset period, a compensating period, a data writing period and a light emitting period.

According to an embodiment of the present disclosure, during the odd-numbered frames, in the reset period, a non-driving voltage is output at the first and the second driving voltage terminals, the first and the second scanning signals are at an active level, and the first and the second driving circuits are reset; in the compensating period, the first driving voltage terminal outputs a driving voltage, the first scanning signal is at the active level, the second scanning signal is at an inactive level, the first driving circuit performs a transistor threshold voltage compensation, and the second driving circuit remains in the reset state; in the data writing period, the first driving voltage terminal is floated and outputs no voltage, the first scanning signal is at the active level, the second scanning signal is at the inactive level, the first driving circuit reads the data signal at the data input terminal, and the second driving circuit remains in the reset state; and in the light emitting period, the first driving voltage terminal outputs the driving voltage, the first scanning signal is at the inactive level, the second scanning signal is at the inactive level, the first driving circuit drives the light emitting circuit to emit light, and the second driving circuit remains in the reset state.

According to an embodiment of the present disclosure, during the even-numbered frames, in the reset period, the non-driving voltage is output at the first and the second driving voltage terminals, the first and the second scanning signals are at the active level, and the first and the second driving circuits are reset; in the compensating period, the second driving voltage terminal outputs the driving voltage, the second scanning signal is at the active level, the first scanning signal is at the inactive level, the second driving circuit performs the transistor threshold voltage compensation, and the first driving circuit remains in the reset state; in the data writing period, the second driving voltage terminal is floated and outputs no voltage, the second scanning signal is at the active level, the first scanning signal is at the inactive level, the second driving circuit reads the data signal at the data input terminal, and the first driving circuit remains in the reset state; and in the light emitting period, the second driving voltage terminal outputs the driving voltage, the second scanning signal is at the inactive level, the first scanning signal is at the inactive level, the second driving circuit drives the light emitting circuit to emit light, and the first driving circuit remains in the reset state.

According to an embodiment of the present disclosure, during the odd-numbered frames, in the reset period, the first and the second switching transistors are turned on, the first and the second driving transistors are turned off, both of the first capacitor and the second capacitor are reset to the reset state, and the light emitting circuit emits no light; in the compensating period, the first switching transistor and the first driving transistor are turned on, the second switching transistor and the second driving transistor are turned off, the first capacitor stores a threshold voltage of the first driving transistor, the second capacitor remains in the reset state, and the light emitting circuit emits no light; in the data writing period, the first switching transistor and the first driving transistor are turned on, the second switching transistor and the second driving transistor are turned off, the first capacitor stores the threshold voltage of the first driving transistor and the data signal at the data input terminal, the second capacitor remains in the reset state, and the light emitting circuit emits no light; and in the light emitting period, the first switching transistor, the second switching transistor and the second driving transistor are turned off, the first capacitor maintains a voltage across its both terminals, the first driving transistor is turned on and drives the light emitting circuit to emit light, and the second capacitor remains in the reset state.

According to an embodiment of the present disclosure, during the even-numbered frames, in the reset period, the first and the second switching transistors are turned on, the first and the second driving transistors are turned off, both of the first capacitor and the second capacitor are reset to the reset state, and the light emitting circuit emits no light; in the compensating period, the first switching transistor and the first driving transistor are turned off, the second switching transistor and the second driving transistor are turned on, the first capacitor remains in the reset state, the second capacitor stores a threshold voltage of the second driving transistor, and the light emitting circuit emits no light; in the data writing period, the first switching transistor and the first driving transistor are turned off, the second switching transistor and the second driving transistor are turned on, the first capacitor remains in the reset state, the second capacitor stores the threshold voltage of the second driving transistor and the data signal at the data input terminal, and the light emitting circuit emits no light; and in the light emitting period, the first switching transistor, the first driving transistor and the second switching transistor are turned off, the first capacitor remains in the reset state, the second capacitor maintains a voltage across its both terminals, and the second driving transistor is turned on and drives the light emitting circuit to emit light.

According to another aspect of the present disclosure, it provides a display panel, comprising a pixel array, a gate driving circuit and a data driving circuit, each pixel in the pixel array including the pixel circuit described above.

In the pixel circuit and the driving method thereof and the display panel according to an embodiment of the present disclosure, the light emitting device is alternately driven to emit light by using the first driving circuit and the second driving circuit, so that the second driving circuit is in the recovery stage during the light emitting device being driven to emit light by the first driving circuit and the first driving circuit is in the recovery stage during the light emitting device being driven to emit light by the second driving circuit, and thereby the driving transistor in each driving circuit can enter a recovery period after operating for a period, and thus the threshold voltage drift of the driving transistor in each driving circuit can be reduced, and the lifespans of the driving transistor of the first driving circuit and the driving transistor of the second driving circuit can be increased, thereby prolonging the lifespan of the display panel.

Other features and advantages of the present disclosure will be set forth in the following specification, and partly become apparent from the specification or will be appreciated by implementing the present disclosure. Objects and other advantages of the present disclosure can be implemented and obtained by structures specially indicated in the specification, claims and drawings.

BRIEF DESCRIPTION OF THE DRAWINGS

The above mentioned and other objects, features and advantages of the present disclosure will become more apparent from the detailed description of the embodiments of the present disclosure in conjunction with the drawings. The drawings are used for providing further understanding to the embodiments of the present disclosure, and constitute a part of the specification to explain the present disclosure along with the embodiments of the present disclosure, but do not make any limitation on the present disclosure. In the drawings, identical reference numerals generally refer to identical components or steps.

DETAILED DESCRIPTION

Figure 1:
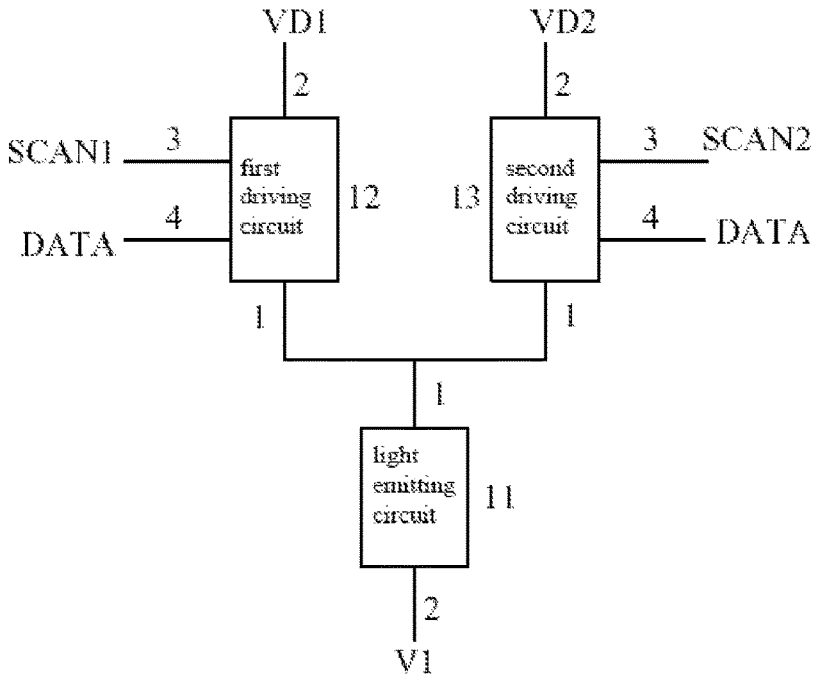
FIG. 1 is a schematic block diagram of a pixel circuit according to an embodiment of the present disclosure.

In order to make the objects, technical solutions and advantages of the embodiments of the present disclosure more apparent, the exemplary embodiments of the present disclosure will be described in details below with reference to the drawings. Obviously, the exemplary embodiments described are only a part of the embodiments of the present disclosure, but not all the embodiments of the present disclosure. All other embodiments obtained by those skilled in the art without any creative work should fall into the scope protected by the present disclosure.

Herein, it should be noted that in the drawings, identical reference numerals are given to components substantially having identical or similar structures and functions, and the repetitive description of them will be omitted.

FIG. 1 is a schematic block diagram of a pixel circuit according to an embodiment of the present disclosure. As illustrated in FIG. 1, the pixel circuit according to an embodiment of the present disclosure comprises a light emitting circuit 11, a first driving circuit 12 and a second driving circuit 13.

A first terminal 1 of the light emitting circuit 11 is connected with a first terminal 1 of the first driving circuit 12 and a first terminal 1 of the second driving circuit 13, and a second terminal 2 thereof is connected with a first power supply voltage terminal V1.

A second terminal 2 of the first driving circuit 12 is connected with a first driving voltage terminal VD1, a third terminal 3 thereof is connected with a first scanning control terminal SCAN1, and a fourth terminal 4 thereof is connected with a data input terminal DATA. The first driving circuit 12 is configured to drive the light emitting circuit 11 to emit light during a first period under control of a first scanning signal at the first scanning control terminal SCAN1.

A second terminal 2 of the second driving circuit 13 is connected with a second driving voltage terminal VD2, a third terminal 3 thereof is connected with a second scanning control terminal SCAN2, and a fourth terminal 4 thereof is connected with the data input terminal DATA. The second driving circuit 13 is configured to drive the light emitting circuit 11 to emit light during a second period under control of a second scanning signal at the second scanning control terminal SCAN2, the first period and the second period not overlapping with each other.

The first driving circuit 12 and the second driving circuit 13 alternately drive the light emitting circuit 11 to emit light.

According to the embodiment of the present disclosure, the duration of the first period equals to that of the second period, and each can be one frame, two frames, multiple frames or any appropriate duration. For example, the first period can be odd-numbered frame and the second period can be even-numbered frame, i.e., the first driving circuit 12 can drive the light emitting circuit 11 to emit light during the odd-numbered frames, and the second driving circuit 13 can drive the light emitting circuit 11 to emit light during the even-numbered frames. As another example, the first period can be even-numbered frame and the second period can be the odd-numbered frame, i.e., the first driving circuit 12 can drive the light emitting circuit 11 to emit light during the even-numbered frames, and the second driving circuit 13 can drive the light emitting circuit 11 to emit light during the odd-numbered frames.

According to the embodiment of the present disclosure, during the first period in which the first driving circuit 12 drives the light emitting circuit 11 to emit light, the second driving circuit 13 is in a recovery stage; whereas during the second period in which the second driving circuit 13 drives the light emitting circuit 11 to emit light, the first driving circuit 12 is in the recovery stage.

By way of making the first driving circuit 12 and the second driving circuit 13 alternately drive the light emitting circuit 11 to emit light, and making the second driving circuit 13 in the recovery stage during the period in which the first driving circuit 12 drives the light emitting circuit 11 to emit light and the first driving circuit 12 in the recovery stage during the period in which the second driving circuit 13 drives the light emitting circuit 11 to emit light, the driving transistor in each of the first driving circuit 12 and the second driving circuit 13 can enter the recovery stage after operating for a period, so that the threshold voltage drift of the driving transistor in each of the first driving circuit 12 and the second driving circuit 13 can be reduced, and thus the lifespan of the display panel can be prolonged.

Figure 2:
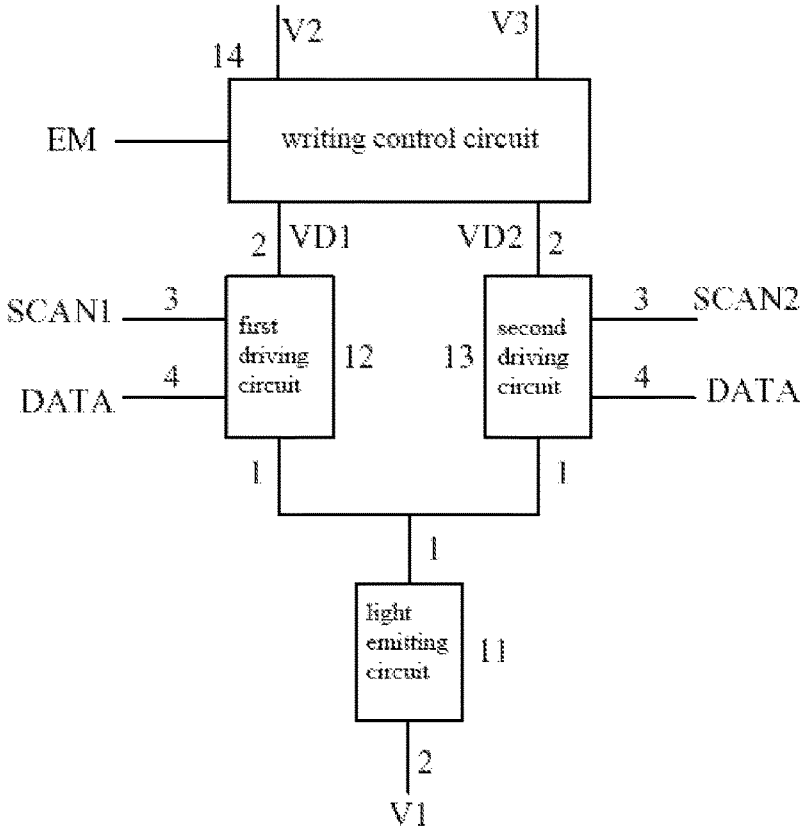
FIG. 2 is another schematic block diagram of the pixel circuit according to an embodiment of the present disclosure.

FIG. 2 is another schematic block diagram of the pixel circuit according to an embodiment of the present disclosure. As illustrated in FIG. 2, the pixel circuit according to the embodiment of the present disclosure further comprises a writing control circuit 14.

A first terminal of the writing control circuit 14 is connected with a second power supply voltage terminal V2, a second terminal thereof is connected with a third power supply voltage terminal V3, a third terminal thereof is connected with a writing control terminal EM, a fourth terminal thereof serves as the first driving voltage terminal VD1, and a fifth terminal thereof serves as the second driving voltage terminal VD2.

The writing control circuit 14 is configured to generate a first driving voltage signal at the first driving voltage terminal VD1 and a second driving voltage signal at the second driving voltage terminal VD2 in accordance with a second power supply voltage signal at the second power supply voltage terminal V2 and a third power supply signal at the third power supply voltage terminal V3, under control of a writing control signal at the writing control terminal EM.

In the following, the pixel circuit according to the embodiment of the present disclosure will be introduced by taking the first period being the odd-numbered frame and the second period being the even-numbered frame as an example.

According to the embodiment of the present disclosure, during the odd-numbered frames, under control of the first scanning signal at the first scanning control terminal SCAN1 and the first driving voltage signal at the first driving voltage terminal VD1, the first driving circuit 12 can read the data signal at the data input terminal DATA and drive the light emitting circuit 11 to emit light according to the read data signal, whereas during the even-numbered frames, the first driving circuit 12 is reset and in the recovery stage.

According to the embodiment of the present disclosure, during the odd-numbered frames, the second driving circuit 13 is reset and in the recovery stage, whereas during the even-numbered frames, under control of the second scanning signal at the second scanning control terminal SCAN2 and the second driving voltage signal at the second driving voltage terminal VD2, the second driving circuit 13 reads the data signal at the data input terminal DATA and drives the light emitting circuit 11 to emit light according to the read data signal.

According to the embodiment of the present disclosure, each frame can be divided into a reset period, a compensating period, a data writing period and a light emitting period.

During the odd-numbered frames (the (2n−1)th frame, n is a natural number), in the reset period, the first driving circuit 12 and the second driving circuit 13 are both reset; in the compensating period, the first driving circuit 12 compensates for the threshold voltage drift of the driving transistor in the first driving circuit 12 under control of the first scanning signal at the first scanning control terminal SCAN1 and the first driving voltage signal at the first driving voltage terminal VD1; in the data writing period, the first driving circuit 12 reads the data signal at the data input terminal DATA under control of the first scanning signal at the first scanning control terminal SCAN1 and the first driving voltage signal at the first driving voltage terminal VD1; in the light emitting period, the first driving circuit 12 drives the light emitting circuit 11 to emit light according to the read data signal; and in the compensating period, the data writing period and the light emitting period, the second driving circuit 13 remains in the reset state and is in the recovery stage.

During the even-numbered frames (the (2n)th frame), in the reset period, the first driving circuit 12 and the second driving circuit 13 are both reset; in the compensating period, the second driving circuit 13 compensates for the threshold voltage drift of the driving transistor in the second driving circuit 13 under control of the second scanning signal at the second scanning control terminal SCAN2 and the second driving voltage signal at the second driving voltage terminal VD2; in the data writing period, the second driving circuit 13 reads the data signal at the data input terminal DATA under control of the second scanning signal at the second scanning control terminal SCAN2 and the second driving voltage signal at the second driving voltage terminal VD2; in the light emitting period, the second driving circuit 13 drives the light emitting circuit 11 to emit light according to the read data signal; and in the compensating period, the data writing period and the light emitting period, the first driving circuit 12 remains in the reset state and is in the recovery stage.

Figure 3:
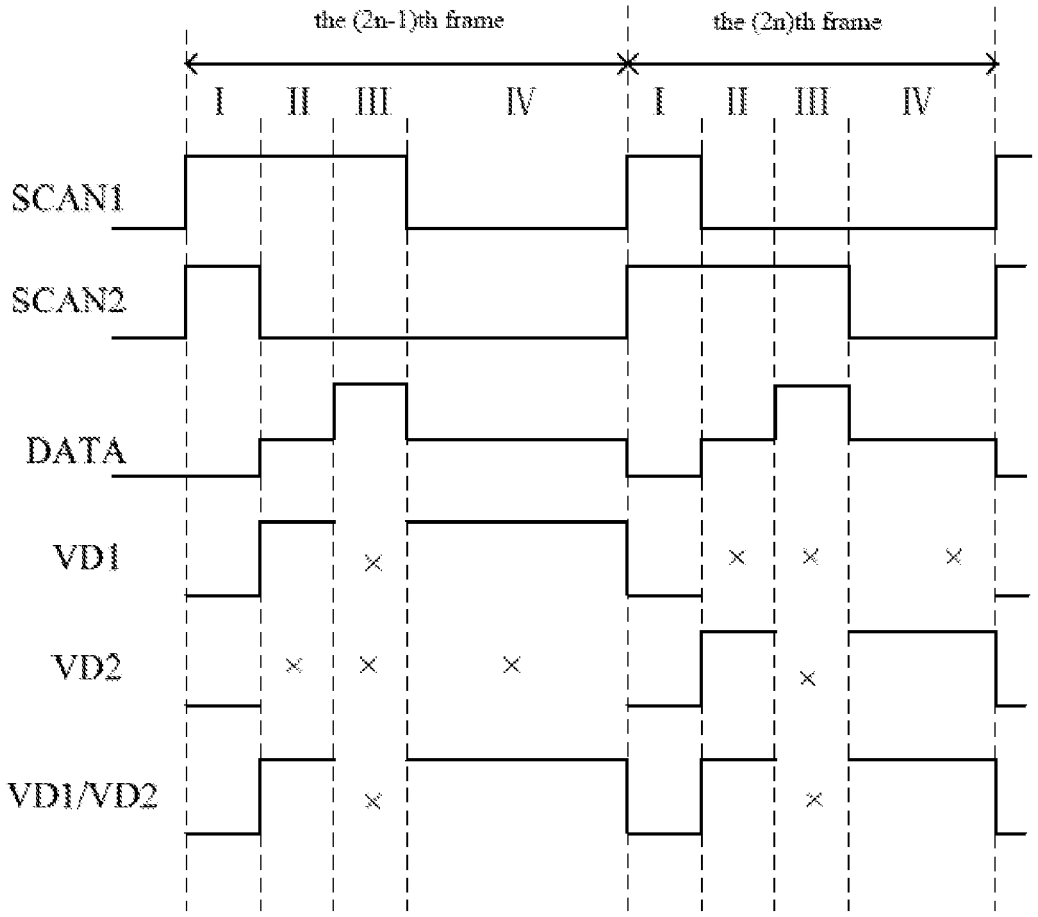
FIG. 3 is a schematic timing diagram of signals at respective signal terminals of the pixel circuit in respective operating periods according to an embodiment of the present disclosure.

FIG. 3 is a schematic timing diagram of signals at respective signal terminals of the pixel circuit in respective operating periods according to an embodiment of the present disclosure. In FIG. 3, the reset period, the compensating period, the data writing period and the light emitting period are represented as I, II, III and IV, respectively.

According to the embodiment of the present disclosure, in the reset period I of each frame, the first driving voltage terminal VD1 and the second driving voltage terminal VD2 both output a non-driving voltage; during the odd-numbered frames, in the data writing period, the first driving voltage terminal VD1 is floated and no voltage is output, and in the compensating period and the light emitting period, the first driving voltage terminal VD1 outputs the driving voltage; in the even-numbered frames, in the data writing period, the second driving voltage terminal VD2 is floated and no voltage is output, and in the compensating period and the light emitting period, the second driving voltage terminal VD2 outputs the driving voltage. Optionally, the second driving voltage terminal VD2 is the same as the first driving voltage terminal VD1 (illustrated as VD1/VD2 in FIG. 3), and the third power supply voltage terminal V3 is the same as the second power supply voltage terminal V2. In such case, in the reset period I of each of the first period and the second period, the first driving voltage terminal VD1 outputs the non-driving voltage; in the data writing period, the first driving voltage terminal VD1 is floated and no voltage is output; and in the compensating period and the light emitting period, the first driving voltage terminal VD1 outputs the driving voltage.

Optionally and as an alternative, the second driving voltage terminal VD2 is different from the first driving voltage terminal VD1, and the third power supply voltage terminal V3 is the same as or different from the second power supply voltage terminal V2. In such case, in the reset period of the odd-numbered frames and the even-numbered frames, the first driving voltage terminal VD1 and the second driving voltage terminal VD2 both output the non-driving voltage; during the odd-numbered frames, in the compensating period, the data writing period and the light emitting period, the second driving voltage terminal VD2 is floated or outputs the non-driving voltage, in the data writing period, the first driving voltage terminal VD1 is floated and no voltage is output, and in the compensating period and the light emitting period, the first driving voltage terminal VD1 outputs the driving voltage; during the even-numbered frames, in the compensating period, the data writing period and the light emitting period, the first driving voltage terminal VD1 is floated or outputs the non-driving voltage, in the data writing period, the second driving voltage terminal VD2 is floated and no voltage is output, and in the compensating period and the light emitting period, the second driving voltage terminal VD2 outputs the driving voltage.

Additionally, according to the embodiment of the present disclosure, during the odd-numbered frames, in the reset period I, the first scanning signal at the first scanning control terminal SCAN1 and the second scanning signal at the second scanning control terminal SCAN2 are both at an active level; in the compensating period II and the data writing period III, the first scanning signal at the first scanning voltage terminal SCAN1 is at the active level and the second scanning signal at the second scanning control terminal SCAN2 is at an inactive level; in the light emitting period IV, the first scanning signal at the first scanning control terminal SCAN1 and the second scanning signal at the second scanning control terminal SCAN2 are both at the inactive level. During the even-numbered frames, in the reset period I, the first scanning signal at the first scanning control terminal SCAN1 and the second scanning signal at the second scanning control terminal SCAN2 are both at the active level; in the compensating period II and the data writing period III, the first scanning signal at the first scanning voltage terminal SCAN1 is at the inactive level and the second scanning signal at the second scanning control terminal SCAN2 is at the active level; in the light emitting period IV, the first scanning signal at the first scanning control terminal SCAN1 and the second scanning signal at the second scanning control terminal SCAN2 are both at the inactive level.

Figure 4:
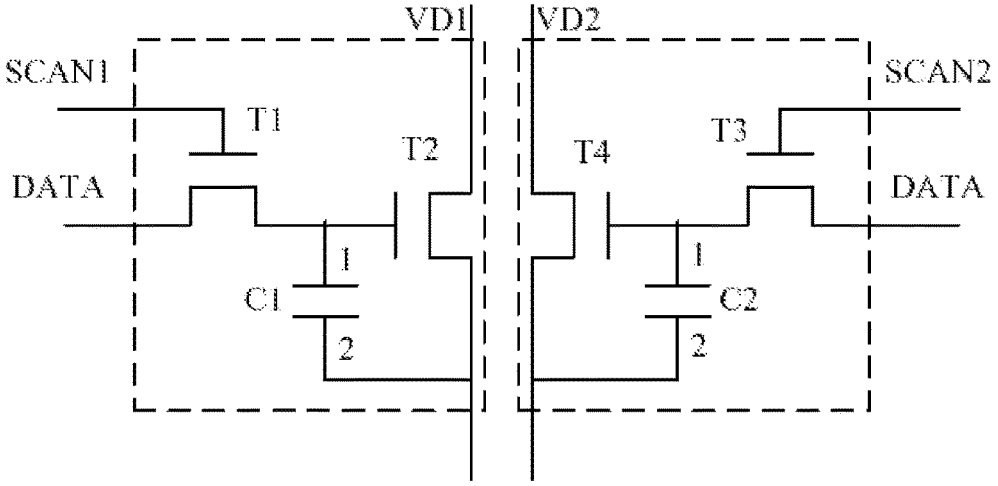
FIG. 4 is an exemplary circuit diagram of a first driving circuit and a second driving circuit in the pixel circuit according to an embodiment of the present disclosure.

FIG. 4 is an exemplary circuit diagram of the first driving circuit 12 and the second driving circuit 13 in the pixel circuit according to an embodiment of the present disclosure.

As illustrated in FIG. 4, the first driving circuit 12 includes a first switching transistor T1, a first driving transistor T2 and a first capacitor C1; and the second driving circuit 13 includes a second switching transistor T3, a second driving transistor T4 and a second capacitor C2.

A gate of the first switching transistor T1 as the third terminal of the first driving circuit 12 is connected with the first scanning control terminal SCAN1, a first electrode of the first switching transistor T1 as the fourth terminal of the first driving circuit 12 is connected with the data input terminal DATA, and a second electrode of the first switching transistor T1 is connected with a gate of the first driving transistor T2 and a first terminal 1 of the first capacitor C1.

A first electrode of the first driving transistor T2 as the second terminal of the first driving circuit 12 is connected with the first driving voltage terminal VD1, and a second electrode of the first driving transistor T2 as the first terminal of the first driving circuit 12 is connected with the first terminal of the light emitting circuit 11 and a second terminal 2 of the first capacitor C1.

A gate of the second switching transistor T3 as the third terminal of the second driving circuit 13 is connected with the second scanning control terminal SCAN2, a first electrode of the second switching transistor T3 as the fourth of the second driving circuit 13 is connected with the data input terminal DATA, and a second electrode of the second switching transistor T3 is connected with a gate of the second driving transistor T4 and a first terminal 1 of the second capacitor C2.

A first electrode of the second driving transistor T4 as the second terminal of the second driving circuit 13 is connected with the second driving voltage terminal VD2, and a second electrode of the second driving transistor T4 as the first terminal of the second driving circuit 13 is connected with the first terminal of the light emitting circuit 11 and a second terminal 2 of the second capacitor C2.

According to the embodiment of the present disclosure, the light emitting circuit 11 can include an organic light emitting diode OLED.

As an example, an anode of the organic light emitting diode serves as the first terminal of the light emitting circuit 11 and a cathode of the organic light emitting diode serves as the second terminal of the light emitting circuit 11, and the first power supply voltage terminal V1 is a low voltage power supply terminal.

Optionally, the first switching transistor T1, the first driving transistor T2, the second switching transistor T3 and the second driving transistor T4 are all N-type transistors, and the first electrode and the second electrode of each transistor are the source and the drain, respectively. In such case, the non-driving voltage is a low voltage and the driving voltage is a high voltage; and the active level of the first and the second scanning signals is a high voltage and the inactive level of the first and the second scanning signals is a low voltage.

Alternatively, the first switching transistor T1, the first driving transistor T2, the second switching transistor T3 and the second driving transistor T4 are all P-type transistors, and the first electrode and the second electrode of each transistor are the source and the drain, respectively. In such case, the non-driving voltage is a low voltage and the driving voltage is a high voltage; and the active level of the first and the second scanning signals is a low voltage and the inactive level of the first and the second scanning signals is a high voltage.

Figure 5:
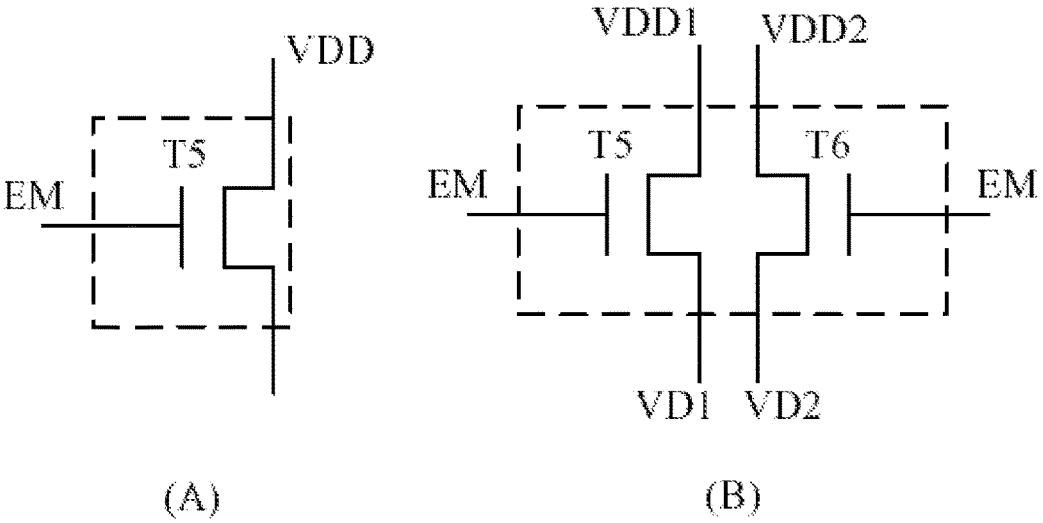
FIG. 5 is an exemplary circuit diagram of a writing control circuit according to an embodiment of the present disclosure.

FIG. 5 is an exemplary circuit diagram of the writing control circuit 14 according to an embodiment of the present disclosure.

As illustrated in (A) of FIG. 5, the writing control circuit 14 according to the embodiment of the present disclosure can include a fifth switching transistor T5. A gate of the fifth switching transistor T5 as the third terminal of the writing control circuit 14 is connected with the writing control terminal EM, a first terminal thereof is connected with the second power supply voltage terminal V2 (VDD), and a second terminal thereof serves as the first and the second driving voltage terminal VD1, VD2. In such case, the second power supply voltage terminal V2 and the third power supply voltage terminal V3 are the same power supply voltage terminal VDD, as described above.

Optionally, the fifth switching transistor T5 is an N-type transistor, and the first electrode and the second electrode thereof are the source and the drain, respectively. In such case, the active level of the writing control signal at the writing control terminal EM is a high level, and the inactive level of the writing control signal is a low level.

Alternatively, the fifth switching transistor T5 is a P-type transistor, and the first electrode and the second electrode thereof are the source and the drain, respectively. In such case, the active level of the writing control signal at the writing control terminal EM is a low level, and the inactive level of the writing control signal is a high level.

As illustrated in (B) of FIG. 5, the writing control circuit 14 according to the embodiment of the present disclosure can include a fifth switching transistor T5 and a six switching transistor T6. A gate of the fifth switching transistor T5 and a gate of the sixth switching transistor T6 as the third terminal of the writing control circuit 14 are connected with the writing control terminal EM, a first electrode of the fifth switching transistor 15 is connected with the second power supply voltage terminal V2 (VDD1), a second electrode of the fifth switching transistor T5 serves as the first driving voltage terminal VD1, a first electrode of the sixth switching transistor T6 is connected with the third power supply terminal V3 (VDD2), and a second electrode of the sixth switching transistor T6 serves as the second driving voltage terminal VD2.

Optionally, the fifth switching transistor T5 and the sixth switching transistor T6 are both N-type transistors, and the first electrode and the second electrode thereof are the source and the drain, respectively. In such case, the active level of the writing control signal at the writing control terminal EM is a high level, and the inactive level of the writing control signal is a low level.

Alternatively, the fifth switching transistor T5 and the sixth switching transistor T6 are both P-type transistors, and the first electrode and the second electrode thereof are the source and the drain, respectively. In such case, the active level of the writing control signal at the writing control terminal EM is a low level, and the inactive level of the writing control signal at the writing control terminal EM is a high level.

Figure 6:
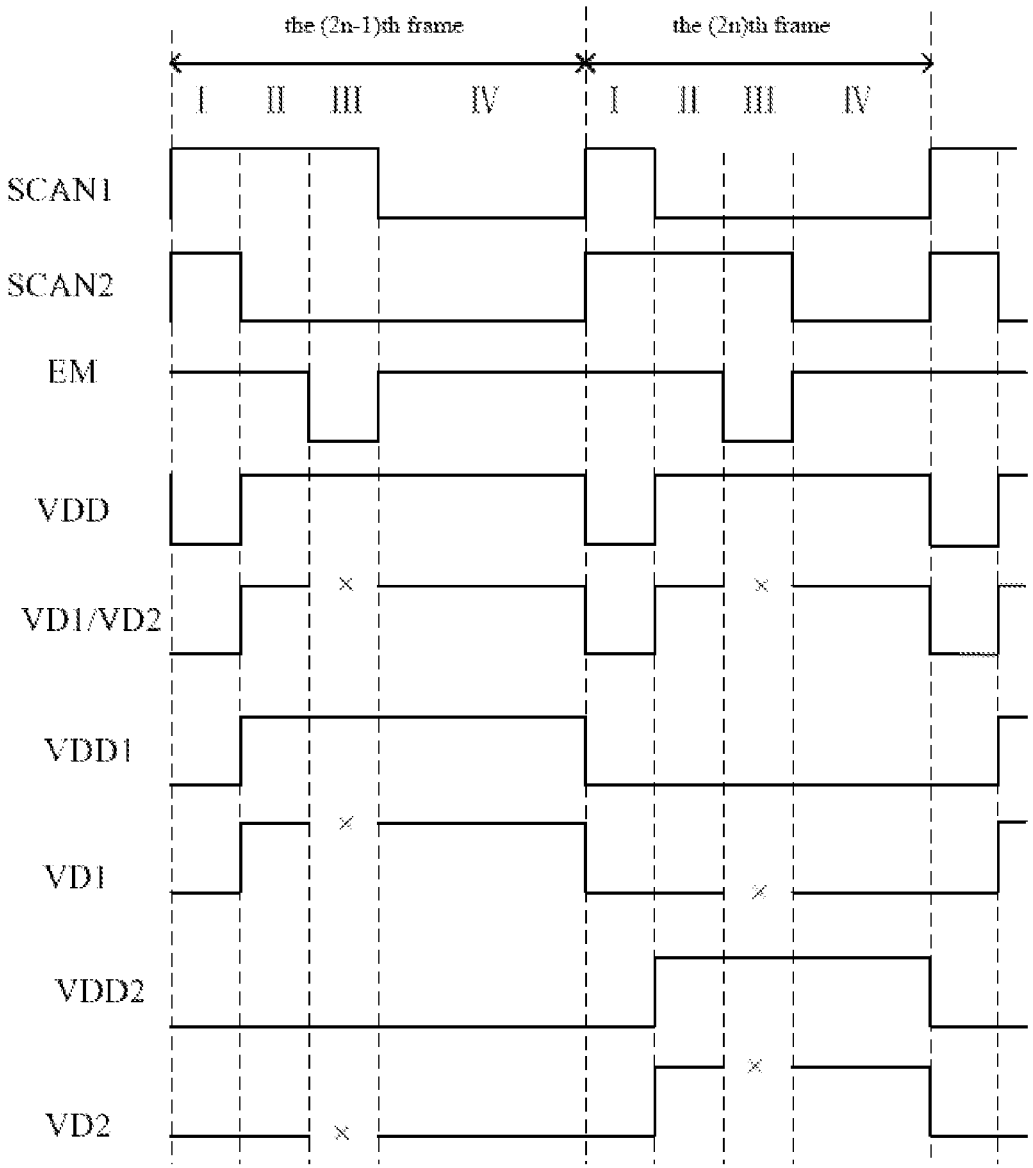
FIG. 6 is a schematic timing diagram of signals at respective signal terminals of the pixel circuit in respective operating periods according to an embodiment of the present disclosure.

FIG. 6 is a schematic timing diagram of signals at respective signal terminals of the pixel circuit in respective operating periods according to an embodiment of the present disclosure.

For the writing control circuit 14 illustrated in (A) of FIG. 5, in the reset period I, the compensating period II and the light emitting period IV, the writing control signal at the writing control terminal EM is at an active level, the fifth switching transistor T5 is turned on, and the power supply signal at the power supply terminal VDD is transmitted to the driving voltage terminal VD1/VD2; while in the data writing period III, the writing control signal at the writing control terminal EM is at an inactive level, the fifth switching transistor T5 is turned off, and the driving voltage terminal VD1/VD2 is floated.

Additionally, in the reset period I, the power supply voltage of the power supply voltage terminal VDD is at the non-driving voltage; in the compensating period II and the light emitting period IV, the power supply voltage of the power supply voltage terminal VDD is at the driving voltage; and in the data writing period III, the power supply voltage of the power supply voltage terminal VDD can be either at the driving voltage or at the non-driving voltage.

For the writing control circuit 14 illustrated in (B) of FIG. 5, during the odd-numbered frames (the (2n−1)th frame, n is a natural number), the power supply voltages of the first power supply voltage terminal VDD1 and the second power supply voltage terminal VDD2 are at the non-driving voltage, and in the compensating period II and the light emitting period IV, the power supply voltage of the first power supply voltage terminal VDD1 is at the driving voltage; in the data writing period III, the power supply voltage of the first power supply voltage terminal VDD1 can be either at the driving voltage or at the non-driving voltage; and in the compensating period II, the data writing period III and the light emitting period IV, the power supply voltage of the second power supply voltage terminal VDD2 can be at the non-driving voltage or the driving voltage.

For the writing control circuit 14 illustrated in (B) of FIG. 5, during the even-numbered frames (the (2n)th frame), the power supply voltages of the first power supply voltage terminal VDD1 and the second power supply voltage terminal VDD2 are at the non-driving voltage, and in the compensating period II and the light emitting period IV, the power supply voltage of the second power supply voltage terminal VDD2 is at the driving voltage; in the data writing period III, the power supply voltage of the second power supply voltage terminal VDD2 can be either at the driving voltage or at the non-driving voltage; and in the compensating period II, the data writing period III and the light emitting period IV, the power supply voltage of the first power supply voltage terminal VDD1 can be at the non-driving voltage or the driving voltage.

Figure 7:
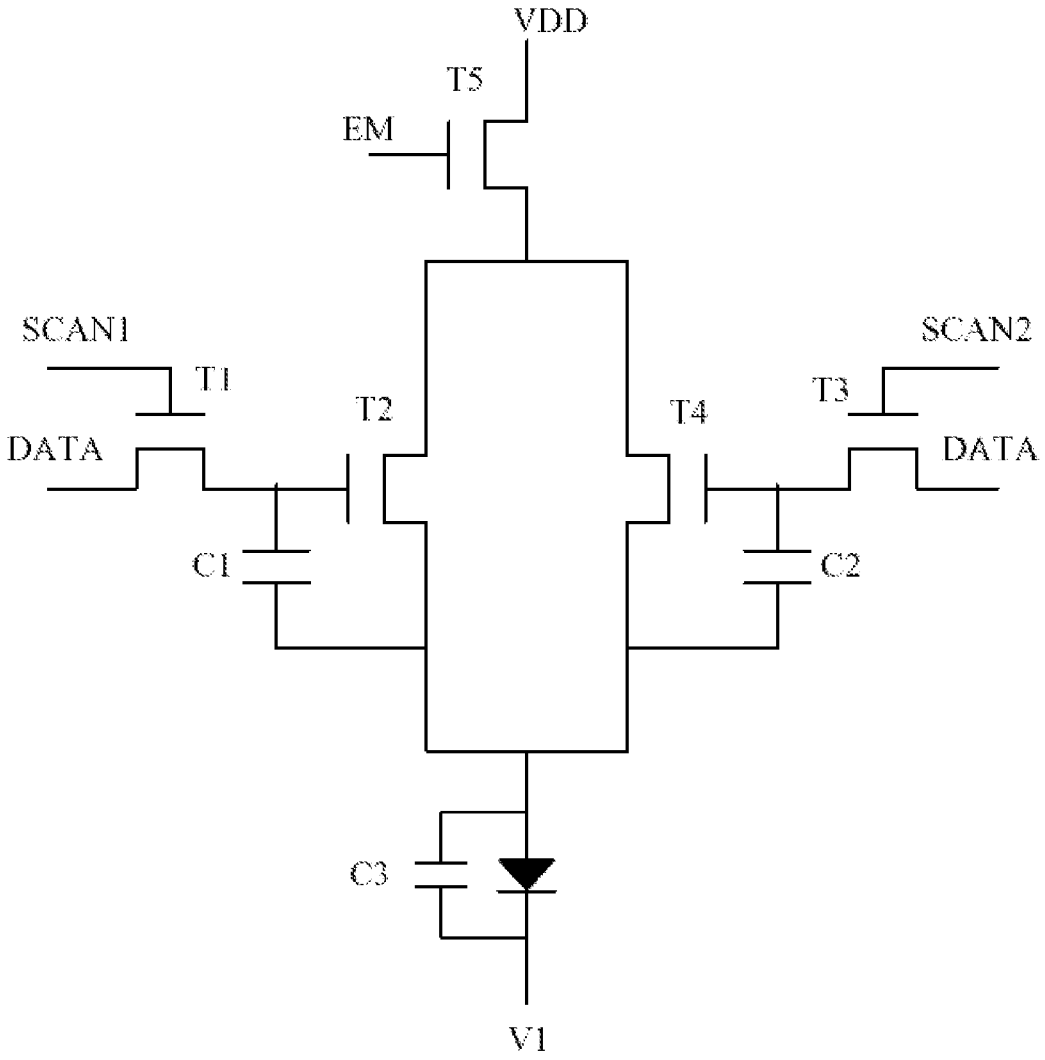
FIG. 7 is an exemplary circuit diagram of the pixel circuit according to an embodiment of the present disclosure.

FIG. 7 is an exemplary circuit diagram of the pixel circuit according to an embodiment of the present disclosure. The writing control circuit in the pixel circuit as illustrated in FIG. 7 is the writing control circuit illustrated in (A) of FIG. 5.

In the following, a driving method of the pixel circuit according to the embodiment of the present disclosure as illustrated in FIG. 7 is described with reference to FIG. 6 and FIGS. 8-11.

During the odd-numbered frames, under control of the first scanning signal at the first scanning control terminal SCAN1, the first driving circuit 12 reads the data signal at the data input terminal DATA and drives the light emitting circuit 11 to emit light according to the read data signal; and under control of the second scanning signal at the second scanning control terminal SCAN2, the second driving circuit 13 is reset and in the recovery stage.

During the even-numbered frames, under control of the second scanning signal at the second scanning control terminal SCAN2, the second driving circuit 13 reads the data signal at the data input terminal DATA and drives the light emitting circuit 11 to emit light according to the read data signal; and under control of the first scanning signal at the first scanning control terminal SCAN1, the first driving circuit 12 is reset and in the recovery stage.

As illustrated in FIG. 6, each frame is divided into the reset period I, the compensating period II, the data writing period III and the light emitting period IV. FIGS. 8-11 are equivalent circuit diagrams of the pixel circuit in respective periods during the odd-numbered frames according to the embodiment of the present disclosure. In the following, the operation of the pixel circuit as illustrated in FIG. 7 according to the embodiment of the present disclosure is described by taking the odd-numbered frames as an example.

Figure 8:
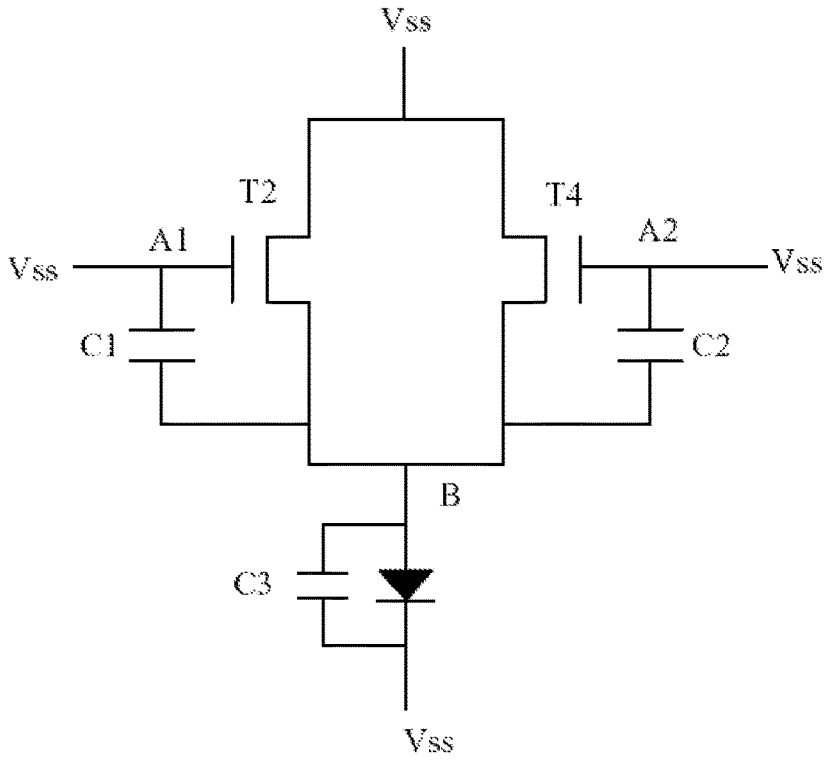
FIG. 8 is an equivalent circuit diagram of the pixel circuit in a reset period according to an embodiment of the present disclosure.

In the reset period I, the second power supply voltage terminal VDD is at the non-driving voltage Vss, the writing control terminal EM is at an active level, the fifth switching transistor T5 in the writing control circuit 14 is turned on, and the first driving voltage terminal VD1 and the second driving voltage terminal VD2 output the power supply voltage of the second power supply voltage terminal VDD, i.e. the non-driving Vss. Additionally, in this period, the first scanning signal at the first scanning control terminal SCAN1 and the second scanning signal at the second scanning control terminal SCAN2 are both at the active level, the first switching transistor T1 of the first driving circuit 12 and the second switching transistor T3 of the second driving circuit 13 are turned on, the data voltage Vss of the data input terminal DATA is transmitted to the gates of the first driving transistor T2 and the second driving transistor T4, the first driving transistor T2 and the second driving transistor T4 are turned off, and the first capacitor C1 and the second capacitor C2 are discharged such that the voltage difference across the both terminals of the first capacitor C1 and the voltage difference across the both terminals of the second capacitor C2 are zero. In this period, the gate-source voltages of the first driving transistor T2 and the second driving transistor T4 are zero, and the first driving transistor T2 and the second driving transistor T4 enter the recovery stage. Additionally, in this period, the capacitor in the light emitting circuit 11, e.g., a parasitic capacitance C3 of the light emitting diode (referred as a third capacitor C3 hereinafter), is further discharged. The equivalent circuit diagram of the pixel circuit in this period according to the embodiment of the present disclosure is illustrated in FIG. 8. In this period, VA1=Vss, VA2=Vss, VB=Vss, and thus the first and the second driving circuits 12 and 13 are reset and the light emitting circuit 11 emits no light.

Figure 9:
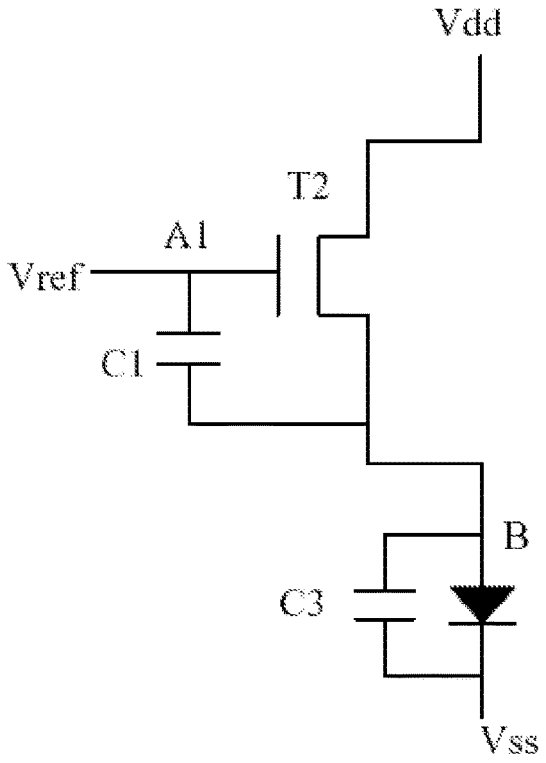
FIG. 9 is an equivalent circuit diagram of the pixel circuit in a compensating period according to an embodiment of the present disclosure.

In the compensating period II, the second power supply voltage terminal VDD is at the driving voltage Vdd, the writing control terminal EM remains at the active level, the fifth switching transistor T5 in the writing control circuit 14 is turned on, and the first driving voltage terminal VD1 and the second driving voltage terminal VD2 output the power supply voltage of the second power supply voltage terminal VDD, i.e. the driving voltage Vdd. Additionally, in this period, the first scanning signal at the first scanning control terminal SCAN1 is at the active level, the first switching transistor T1 in the first driving circuit 12 remains on, the data voltage Vref of the data input terminal DATA is transmitted to the gate of the first driving transistor T2, wherein Vref−Vss>Vth2 (Vth2 is the threshold voltage of the first driving transistor T2), the first driving transistor T2 is turned on and the third capacitor C3 is charged; the second scanning signal at the second scanning control terminal SCAN2 is at an inactive level, the second switching transistor T3 in the second driving circuit 13 is turned off, and the second driving transistor T4 remains off, i.e., the second driving circuit 13 remains in the reset state. When entering the compensating period, VA1=Vref, VB=Vss, and Vgs2=Vref−Vss>Vth2, wherein Vgs2 is the gate-source voltage of the first driving transistor T2, therefore, the first driving transistor T2 is turned on. As the third capacitor C3 is charged, the voltage VB at node B rises, and the first driving transistor T2 is turned off when VB rises up to Vref−Vth2, and thus the voltage stored across both terminals of the first capacitor C1 is VC1=VA1−VB=Vref−(Vref−Vth2)=Vth2. The equivalent circuit diagram of the pixel circuit in this period according to the embodiment of the present disclosure is illustrated in FIG. 9. When this period ends, VA1=Vref, VB=Vref−Vth2, VC1=Vth2, and thus the first capacitor C1 stores the threshold voltage of the first driving transistor T2, i.e., the first driving circuit 12 performs the threshold voltage compensation of the first driving transistor T2, and the light emitting circuit 11 emits no light.

Figure 10:
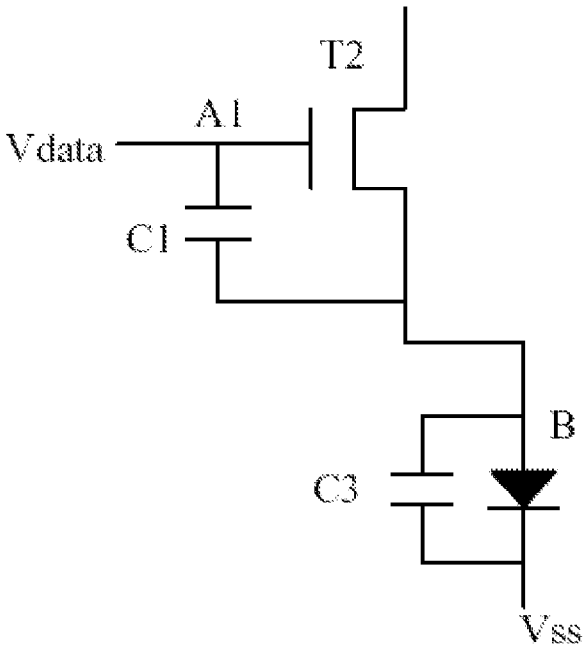
FIG. 10 is an equivalent circuit diagram of the pixel circuit in a data writing period according to an embodiment of the present disclosure.

In the data writing period III, the second power supply voltage terminal VDD is at the driving voltage Vdd or at the non-driving voltage Vss, the writing control terminal EM is at the inactive level, the fifth switching transistor T5 in the writing control circuit 14 is turned off, and the first driving voltage terminal VD1 and the second driving voltage terminal VD2 are floated. Additionally, in this period, the first scanning signal at the first scanning control terminal SCAN1 is at the active level, the first switching transistor T1 in the first driving circuit 12 remains on, the data voltage Vdata of the data input terminal DATA is transmitted to the gate of the first driving transistor T2, wherein Vdata−VB=Vdata−(Vref−Vth2)=Vth2+(Vdata−Vref)>Vth2, and the first driving transistor T2 is turned on; the second scanning signal at the second scanning control terminal SCAN2 is at the inactive level, the second switching transistor T3 in the second driving circuit 13 remains off, and the second driving transistor T4 remains off, i.e., the second driving circuit 13 remains in the reset state. In this period, although the first driving transistor T2 is turned on, the voltage at node B is determined by the capacitances of the first capacitor C1 and the third capacitor C3 since the first driving voltage terminal VD1 is floated, therefore, VB=(Vref−Vth2)+a1(Vdata−Vref) when the third capacitor C3 completes charging, wherein =C1/(C1+C3). The equivalent circuit diagram of the pixel circuit in this period according to the embodiment of the present disclosure is illustrated in FIG. 10. When this period ends, VA1=Vdata, VB=(Vref−Vth2)+a1(Vdata−Vref), Vgs2=VA1−VB=(1−a1)(Vdata−Vref)+Vth2, and thus the first capacitor C1 stores the threshold voltage Vth2 of the first driving transistor T2 and the data signal Vdata of the data input terminal DATA, i.e., the first driving circuit 12 reads the data signal Vdata of the data input terminal DATA, and the light emitting circuit 11 emits no light.

Figure 11:
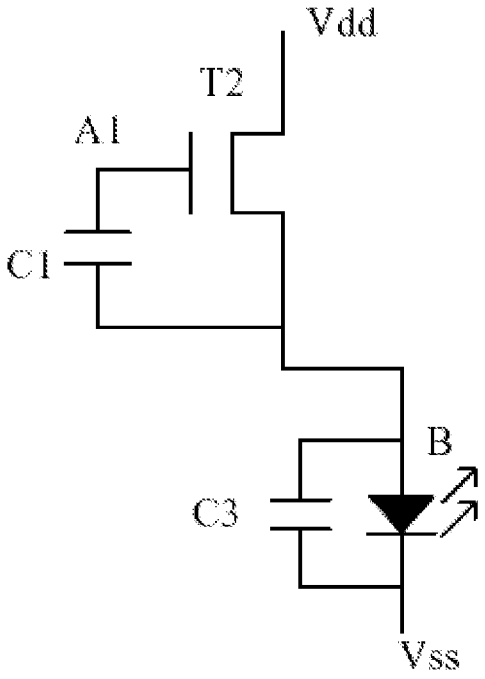
FIG. 11 is an equivalent circuit diagram of the pixel circuit in a light emitting period according to an embodiment of the present disclosure.

In the light emitting period IV, the second power supply voltage terminal VDD is at the driving voltage Vdd, the writing control terminal EM is at the active level, the fifth switching transistor T5 in the writing control circuit 14 is turned on, and the first driving voltage terminal VD1 and the second driving voltage terminal VD2 output the power supply voltage of the second power supply voltage terminal VDD, i.e. the driving voltage Vdd. Additionally, in this period, the first scanning signal at the first scanning control terminal SCAN1 is at the inactive level, the first switching transistor T1 in the first driving circuit 12 is turned off, the first capacitor C1 maintains the voltage across its both terminals, and the first driving transistor T2 is turned on and drives the light emitting circuit 11 to emit light; the second scanning signal at the second scanning control terminal SCAN2 is at the inactive level, the second switching transistor T3 in the second driving circuit 13 remains off, and the second driving transistor T4 remains off, i.e., the second driving circuit 13 remains in the reset state. The equivalent circuit diagram of the pixel circuit in this period according to the embodiment of the present disclosure is illustrated in FIG. 11. In this period, the gate-source voltage of the first driving transistor T2 is maintained to be Vgs2=(1−a1)(Vdata−Vref)+Vth2, and thus the first driving transistor T2 remains on, and the current $I_{OLED}$ flowing through the fifth driving transistor T5, the first driving transistor T2 and the light emitting device can be represented as:

$$I_{OLED} = \frac{1}{2}\cdot\mu_n\cdot \mathrm{Cox}\cdot\frac{W2}{L2}\cdot(Vgs2 - Vth2)^2 = \frac{1}{2}\cdot\mu_n\cdot \mathrm{Cox}\cdot\frac{W2}{L2}\cdot[(1-a1)(Vdata - Vref)]^2.$$

Wherein W2 and L2 are a channel width and a channel length of the first driving transistor T2, respectively, $\mu_n$ is an effective carrier mobility, and Cox is a dielectric constant of the gate insulation layer.

It can be known from the above equation that during the odd-numbered frames, the current $I_{OLED}$ flowing through the light emitting device is irrelevant to the threshold voltage of the first driving transistor T2, but is only related to the data voltage Vref applied at the data input terminal in the compensating period and the data voltage Vdata applied at the data input terminal in the data writing period, thereby eliminating the influence of the nonuniformity and drift of the threshold voltage of the driving transistor T2 on the luminance of the light emitting device.

The operation of the pixel circuit during the odd-numbered frames according to the embodiment of the present disclosure is described above, in which, specifically, during the odd-numbered frames, the first driving circuit in the pixel circuit according to the embodiment of the present disclosure reads the data signal at the data input terminal DATA and drives the light emitting circuit to emit light according to the read data signal, while the second driving circuit is reset and in the recovery stage.

Similarly, during the even-numbered frames, the second driving circuit in the pixel circuit according to the embodiment of the present disclosure reads the data signal at the data input terminal DATA and drives the light emitting circuit to emit light according to the read data signal, while the first driving circuit is reset and in the recovery stage.

In the reset period I, the operation of the pixel circuit according to the embodiment of the present disclosure is the same as the operation in the reset period I during the odd-numbered frames, and no further details are given herein.

In the compensating period II, the second power supply voltage terminal VDD is at the driving voltage Vdd, the writing control terminal EM remains at the active level, the fifth switching transistor T5 in the writing control circuit 14 is turned on, and the first driving voltage terminal VD1 and the second driving voltage terminal VD2 output the driving voltage Vdd. Additionally, in this period, the second scanning signal at the second scanning control terminal SCAN2 is at the active level, the second switching transistor T3 in the second driving circuit 13 remains on, the data input terminal DATA inputs the data voltage Vref, Vref−Vss>Vth4, wherein, Vth4 is the threshold voltage of the second driving transistor T4 in the second driving circuit 13, the second driving transistor T4 is turned on, and the third capacitor C3 is charged; the first scanning signal at the first scanning control terminal SCAN1 is at the inactive level, the first switching transistor T1 in the first driving circuit 12 is turned off, the first driving transistor T2 remains off, i.e., the first driving circuit 12 remains in the reset state. When entering the compensating period II, VA2=Vref, VB=Vss, and the data voltage Vgs4=Vref−Vss>Vth4, wherein, Vgs4 is the gate-source voltage of the first driving transistor T2, and thus the second driving transistor T4 is turned on. As the third capacitor C3 is being charged, the voltage VB at node B rises, and the second driving transistor T4 is turned off when VB rises up to Vref−Vth4, and thus the voltage stored across both terminals of the second capacitor C2 is VC2=VA2−VB=Vref−(Vref−Vth4)=Vth4. When this period ends, VA2=Vref, VB=Vref−Vth4, and thus the second capacitor C2 stores the threshold voltage of the second driving transistor T4, i.e., the second driving circuit 13 performs the threshold voltage compensation of the second driving transistor T4, and the light emitting circuit 11 emits no light.

In the data writing period III, the second power supply voltage terminal VDD is at the driving voltage Vdd or at the non-driving voltage Vss, the writing control terminal EM is at the inactive level, the fifth switching transistor T5 in the writing control circuit 14 is turned off, and the first driving voltage terminal VD1 and the second driving voltage terminal VD2 are floated. Additionally, in this period, the second scanning signal at the second scanning control terminal SCAN2 is at the active level, the second switching transistor T3 of the second driving circuit 13 remains on, the data input terminal DATA inputs the data voltage Vdata, Vdata−VB=Vdata−(Vref−Vth4)=Vth4+(Vdata−Vref), and the second driving transistor T4 is turned on; the first scanning signal at the first scanning control terminal SCAN1 is at the inactive level, and the first switching transistor T1 and the first driving transistor T2 of the first driving circuit 12 remain off, i.e., the first driving circuit 12 remains in the reset state. In this period, the voltage at node B is determined by the capacitances of the second capacitor C2 and the third capacitor C3 when the third capacitor C3 completes charging, and VB=(Vref−Vth4)+a2(Vdata−Vref), wherein a2=C2/(C2+C3). When this period ends, VA2=Vdata, VB=(Vref−Vth4)+a2(Vdata−Vref), Vgs4=VA2−VB=(1−a2) (Vdata−Vref)+Vth4, and thus the second capacitor C2 stores the threshold voltage Vth4 of the second driving transistor T4 and the data signal Vdata of the data input terminal DATA, i.e., the second driving circuit 13 reads the data signal Vdata of the data input terminal DATA, and the light emitting circuit 11 emits no light.

In the light emitting period IV, the second power supply voltage terminal VDD is at the driving voltage Vdd, the writing control terminal EM is at the active level, the fifth switching transistor T5 in the writing control circuit 14 is turned on, and the first driving voltage terminal VD1 and the second driving voltage terminal VD2 output the driving voltage Vdd. Additionally, in this period, the second scanning signal at the second scanning control terminal SCAN2 is at the inactive level, the second switching transistor T3 in the second driving circuit 13 is turned off, the second capacitor C2 maintains the voltage across its both terminals, and the second driving transistor T4 is turned on and drives the light emitting circuit 11 to emit light; the first scanning signal at the first scanning control terminal SCAN1 is at the inactive level, the first switching transistor T1 in the first driving circuit 12 remains off, and the first driving transistor T2 remains off, i.e., the first driving circuit 12 remains in the reset state. In this period, the gate-source voltage of the second driving transistor T4 remains to be Vgs4=(1−a2) (Vdata−Vref)+Vth4, and thus the second driving transistor T4 remains on, and the current $I_{OLED}$ flowing through the fifth driving transistor T5, the second driving transistor T4 and the light emitting device can be represented as:

$$I_{OLED} = \frac{1}{2} \cdot \mu_n \cdot Cox \cdot \frac{W4}{L4} \cdot (Vgs4 - Vth4)^2 = \frac{1}{2} \cdot \mu_n \cdot Cox \cdot \frac{W4}{L4} \cdot [(1 - a2)(Vdata - Vref)]^2.$$

Wherein W4 and L4 are a channel width and a channel length of the second driving transistor T4, respectively.

It can be known from the above equation that during the even-numbered frames, the current $I_{OLED}$ flowing through the light emitting device is irrelevant to the threshold voltage of the second driving transistor T4, but is only related to the data voltage Vref applied at the data input terminal in the compensating period and the data voltage Vdata applied at the data input terminal in the data writing period, thereby eliminating the influence of the nonuniformity and drift of the threshold voltage of the driving transistor T4 on the luminance of the light emitting device.

In order to maintain the same luminance of the light emitting device under the same data voltage during the odd-numbered frames and the even-numbered frames, the structural parameters of the first capacitor C1 and the second capacitor C2 can be the same in the circuit structure, and the structural parameters of the first driving transistor T2 and the second driving transistor T4 can be the same in the circuit structure, that is, the capacitances of the first capacitor C1 and the second capacitor C2 are the same, and the channel parameters (width and length) of the first driving transistor T2 and the second driving transistor T4 are the same.

The operation of the pixel circuit adopting the writing control circuit 14 illustrated in (A) of FIG. 5 during the odd-numbered frames and the even-numbered frames according to the embodiment of the present disclosure is described above, and the operation of the pixel circuit adopting the writing control circuit 14 illustrated in (B) of FIG. 5 during the odd-numbered frames and the even-numbered frames according to the embodiment of the present disclosure will be briefly described below.

As illustrated in (B) of FIG. 5, the second driving voltage terminal VD2 is different from the first driving voltage terminal VD1, and the third power supply voltage terminal VDD2 is the same as or different from the second power supply voltage terminal VDD1.

In the following, first of all, the operation of the pixel circuit adopting the writing control circuit 14 illustrated in (B) of FIG. 5 during the odd-numbered frames according to the embodiment of the present disclosure is described.

In the reset period I, the second power supply voltage terminal VDD1 and the third power supply voltage terminal VDD2 are both at the non-driving voltage Vss, the writing control terminal EM is at the active level, the fifth switching transistor T5 and the sixth switching transistor T6 in the writing control circuit 14 are turned on, and the first driving voltage terminal VD1 and the second driving voltage terminal VD2 both output the non-driving voltage Vss. Additionally, in this period, the first scanning signal at the first scanning control terminal SCAN1 and the second scanning signal at the second scanning control terminal SCAN2 are both at the active level, and the first switching transistor T1 in the first driving circuit 12 and the second switching transistor T3 in the second driving circuit 13 are turned on, the data input terminal DATA inputs the data voltage Vss, and the first driving transistor T2 and the second driving transistor T4 are turned off. In this period, VA1=Vss, VA2=Vss, and VB=Vss.

In the compensating period II, the data writing period III and the light emitting period IV, the operations of the fifth switching transistor T5 in the writing control circuit 14, and the first switching transistor T1 and the first driving transistor T2 in the first driving circuit 12 are the same as the operations of the pixel circuit adopting the writing control circuit 14 illustrated in (A) of FIG. 5 during the odd-numbered frames according to the embodiment of the present disclosure, and no further details are given herein.

Additionally, in the compensating period II, the data writing period III and the light emitting period IV, the third power supply voltage terminal VDD2 can be at the driving voltage or the non-driving voltage, the operation of the sixth switching transistor T6 in the writing control circuit 14 is the same as the operation of the fifth switching transistor T5, and the difference is only in that the second driving voltage terminal VD2 outputs the power supply voltage of the third power supply voltage terminal VDD2; additionally, the operations of the second switching transistor T3 and the second driving transistor T4 in the second driving circuit 13 are the same as the operations of the second switching transistor T3 and the second driving transistor T4 in the pixel circuit adopting the writing control circuit 14 illustrated in (A) of FIG. 5 during the odd-numbered frames according to the embodiment of the present disclosure, and no further details are given herein.

In the following, the operation of the pixel circuit adopting the writing control circuit 14 illustrated in (B) of FIG. 5 during the even-numbered frames according to the embodiment of the present disclosure is briefly described.

In the reset period I, the operation of the pixel circuit adopting the writing control circuit 14 illustrated in (B) of FIG. 5 according to the embodiment of the present disclosure is the same as the operation in the reset period I during the odd-numbered frames, and no further details are given herein.

In the compensating period II, the data writing period III and the light emitting period IV, the operations of the sixth switching transistor T6 in the writing control circuit 14, and the second switching transistor T3 and the second driving transistor T4 in the second driving circuit 13 are the same as the operations of those of the pixel circuit adopting the writing control circuit 14 illustrated in (A) of FIG. 5 during the even-numbered frames according to the embodiment of the present disclosure, and no further details are given herein.

Additionally, in the compensating period II, the data writing period III and the light emitting period IV, the second power supply voltage terminal VDD1 can be at the driving voltage or the non-driving voltage, the operation of the fifth switching transistor T5 in the writing control circuit 14 is the same as the operation of the sixth switching transistor T6, and the difference is only in that the first driving voltage terminal VD1 outputs the power supply voltage of the second power supply voltage terminal VDD1; additionally, the operations of the first switching transistor T1 and the first driving transistor T2 in the first driving circuit 12 are the same as the operations of the first switching transistor T1 and the first driving transistor T2 in the pixel circuit adopting the writing control circuit 14 illustrated in (A) of FIG. 5 during the even-numbered frames according to the embodiment of the present disclosure, and no further details are given herein.

Figure 12:
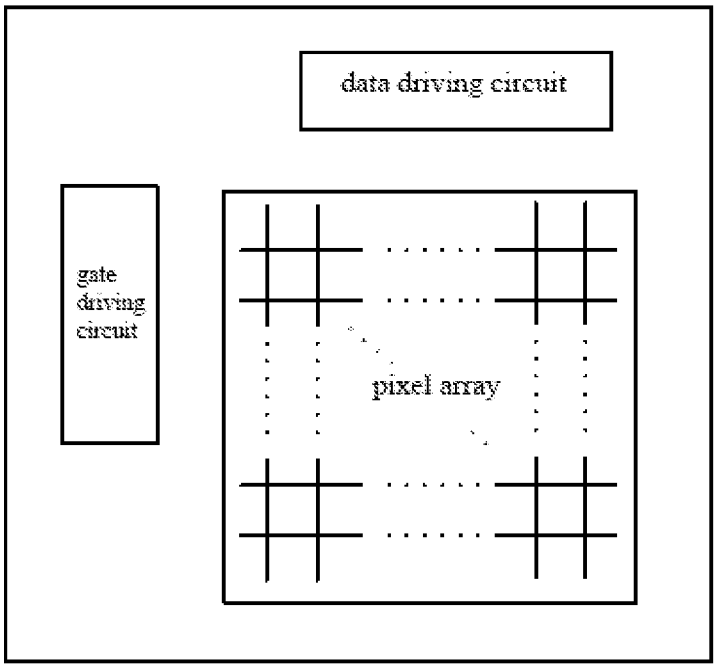
FIG. 12 is a schematic block diagram of a display panel according to an embodiment of the present disclosure.

FIG. 12 is a schematic block diagram of a display panel according to an embodiment of the present disclosure. As illustrated in FIG. 12, the display panel according to the embodiment of the present disclosure includes a pixel array, a gate driving circuit and a data driving circuit, and each pixel in the pixel array includes the pixel circuit according to the embodiment of the present disclosure as described above.

The gate driving circuit generates the scanning signals for pixels of each row in the pixel array. Specifically, for pixels of each row in the pixel array, the gate driving circuit generates the first scanning signal and the second scanning signal as described above, and the first scanning signal is used to control the operation of the first driving circuit 12 and the second scanning signal is used to control the operation of the second driving circuit 13.

The data driving circuit generates the data signals for pixels of each column in the pixel array. Specifically, for pixels of each column in the pixel array, the data driving circuit generates the data signals Vss, Vref and Vdata as described above in the reset period, the compensating period and the data writing period of each frame, respectively.

In the pixel circuit and the driving method thereof and the display panel according to an embodiment of the present disclosure, the light emitting device is alternately driven to emit light by using the first driving circuit and the second driving circuit, so that the second driving circuit is in the recovery stage during the light emitting device being driven to emit light by the first driving circuit and the first driving circuit is in the recovery stage during the light emitting device being driven to emit light by the second driving circuit, and thereby the driving transistor in each driving circuit can enter a recovery period after operating for a period, and thus the threshold voltage drift of the driving transistor in each driving circuit can be reduced, thereby prolonging the lifespan of the display panel.

Each embodiment of the present disclosure is described above in details. However, those skilled in the art is appreciate that various modifications, combinations or sub-combinations can be made to these embodiments without departing from the principle and spirit of the present disclosure, and such modifications should fall into the scope of the present disclosure.

This application claims priority of Chinese Patent Application No. 201610004541.0 filed on Jan. 4, 2016 and entitled "PIXEL CIRCUIT AND DRIVING METHOD THEREOF, DISPLAY PANEL", the disclosure of which is hereby incorporated by reference in its entirety.

What is claimed is:

1. A pixel circuit, comprising:

a light emitting circuit, having a first terminal connected with a first terminal of a first driving circuit and a first terminal of a second driving circuit, a second terminal connected with a first power supply voltage terminal;

the first driving circuit, having a second terminal connected with a first driving voltage terminal, a third terminal connected with a first scanning control terminal, a fourth terminal connected with a data input terminal, and configured to drive the light emitting circuit to emit light during a first period under control of a first scanning signal at the first scanning control terminal; and the second driving circuit, having a second terminal connected with a second driving voltage terminal, a third terminal connected with a second scanning control terminal, a fourth terminal connected with the data input terminal, and configured to drive the light emitting circuit to emit light during a second period under control of a second scanning signal at the second scanning control terminal, the first period and the second period not overlapping with each other and being frames adjacent to each other;

wherein the first driving circuit and the second driving circuit are configured to alternately drive the light emitting circuit to emit light, wherein each frame is divided into a reset period, a compensating period, a data writing period and a light emitting period, during the odd-numbered frames, in the reset period, a non-driving voltage is output at the first and the second driving voltage terminals, and data voltages of the data input terminal are provided to the fourth terminals of the first and second driving circuits, wherein the data voltages are voltages equal to the non-driving voltages; in the data writing period, the first driving voltage terminal is configured to be floated and to output no voltage; in the compensating period and the light emitting period, the first driving voltage terminal configured to be output a driving voltage;

during the even-numbered frames, in the reset period, the non-driving voltage is output at the first and the second driving voltage terminals, and data voltages of the data input terminal are provided to the fourth terminals of the first and second driving circuits, wherein the data voltages are voltages equal to the non-driving voltages; in the data writing period, the second driving voltage terminal is configured to be floated and to output no voltage; in the compensating period and the light emitting period, the second driving voltage terminal is configured to output the driving voltage.

2. The pixel circuit of claim 1, wherein during the first period in which the first driving circuit drives the light emitting circuit to emit light, the second driving circuit is configured to be in a recovery stage; and during the second period in which the second driving circuit drives the light emitting circuit to emit light, the first driving circuit is configured to be in the recovery stage.

3. The pixel circuit of claim 2, wherein the first driving circuit is configured to: read a data signal at the data input terminal and drive the light emitting circuit to emit light according to the read data signal during odd-numbered frames under control of the first scanning signal at the first scanning control terminal and a first driving voltage signal at the first driving voltage terminal, and be reset and in the recovery stage during even-numbered frames;

the second driving circuit is configured to: be reset and in the recovery stage during odd-numbered frames, and read the data signal at the data input terminal and drive the light emitting circuit to emit light according to the read data signal during even-numbered frames under control of the second scanning signal at the second scanning control terminal and a second driving voltage signal at the second driving voltage terminal.

4. The pixel circuit of claim 3, wherein, during the odd-numbered frames, in the reset period, the compensating period and the data writing period, the first scanning signal is at an active level, and in the light emitting period, the first scanning signal is at an inactive level; in the reset period, the second scanning signal is at the active level, and in the compensating period, the data writing period and the light emitting period, the second scanning signal is at the inactive level;

during the even-numbered frames, in the reset period, the first scanning signal is at the active level, and in the compensating period, the data writing period and the light emitting period, the first scanning signal is at the inactive level; in the reset period, the compensating period and the data writing period, the second scanning signal is at the active level, and in the light emitting period, the second scanning signal is at the inactive level.

5. The pixel circuit of claim 4, further comprising:

a writing control circuit, having a first terminal connected with a second power supply voltage terminal, a second terminal connected with a third power supply voltage terminal, a third terminal connected with a writing control terminal, a fourth terminal serving as the first driving voltage terminal, and a fifth terminal serving as the second driving voltage terminal.

6. The pixel circuit of claim 5, wherein the second driving voltage terminal is the same as the first driving voltage terminal, the third power supply voltage terminal is the same as the second power supply voltage terminal;

wherein, in the reset period, the first driving voltage terminal is configured to output the non-driving voltage; in the data writing period, the first driving voltage terminal is configured to be floated and to output no voltage; in the compensating period and the light emitting period, the first driving voltage terminal is configured to output the driving voltage.

7. The pixel circuit of claim 5, wherein the second driving voltage terminal is different from the first driving voltage terminal, the third power supply voltage terminal is the same as or different from the second power supply voltage terminal;

Wherein, during the odd-numbered frames, in the reset period, the first driving voltage terminal and the second driving voltage terminal are configured to output the non-driving voltage; in the data writing period, the first driving voltage terminal is configured to be floated and to output no voltage; in the compensating period and the light emitting period, the first driving voltage terminal is configured to output the driving voltage; in the compensating period, the data writing period and the light emitting period, the second driving voltage terminal is configured to be floated or to output the non-driving voltage;

during the even-numbered frames, in the reset period, the first driving voltage terminal and the second driving voltage terminal are configured to output the non-driving voltage; in the data writing period, the second driving voltage terminal is configured to be floated and to output no voltage; in the compensating period and the light emitting period, the second driving voltage terminal is configured to output the driving voltage; in the compensating period, the data writing period and the light emitting period, the first driving voltage terminal is configured to be floated or to output the non-driving voltage.

8. The pixie circuit of claim 5, wherein the first driving circuit includes a first switching transistor, a first driving transistor and a first capacitor; a gate of the first switching transistor, as the third terminal of the first driving circuit, is connected with the first scanning control terminal, a first electrode of the first switching transistor, as the fourth terminal of the first driving circuit, is connected with the data input terminal, a second electrode of the first switching transistor is connected with a gate of the first driving transistor and a first terminal of the first capacitor; a first electrode of the first driving transistor, as the second terminal of the first driving circuit, is connected with the first driving voltage terminal, a second electrode of the first driving transistor, as the first terminal of the first driving circuit, is connected with the first terminal of the light emitting circuit and a second terminal of the first capacitor;

the second driving circuit includes a second switching transistor, a second driving transistor and a second capacitor; a gate of the second switching transistor, as the third terminal of the second driving circuit, is connected with the second scanning control terminal, a first electrode of the second switching transistor, as the fourth terminal of the second driving circuit, is connected with the data input terminal, a second electrode of the second switching transistor is connected with a gate of the second driving transistor and a first terminal of the second capacitor; a first electrode of the second driving transistor, as the second terminal of the second driving circuit, is connected with the second driving voltage terminal, a second electrode of the second driving transistor, as the first terminal of the second driving circuit, is connected with the first terminal of the light emitting circuit and a second terminal of the second capacitor.

9. The pixel circuit of claim 8, wherein the first switching transistor, the first driving transistor, the second switching transistor and the second driving transistor are all N-type transistors, and the first electrode and the second electrode of each switching transistor are a drain and a source, respectively, the light emitting circuit includes an organic light emitting diode, an anode of the organic light emitting diode serves as the first terminal of the light emitting circuit, and a cathode of the organic light emitting diode serves as the second terminal of the light emitting circuit, wherein the non-driving voltage is a low voltage, the driving voltage is a high voltage; and the active level is a high level, the inactive level is a low level.

10. The pixel circuit of claim 6, wherein the writing control circuit includes a fifth switching transistor, having a gate as the third terminal of the writing control circuit connected with the writing control terminal, a first terminal connected with the second power supply voltage terminal, a second terminal serving as the first and the second driving voltage terminal, wherein, in the data writing period, a writing control signal at the writing control terminal is at the inactive level such that the fifth switching transistor is turned off, and in the other periods, the writing control signal at the writing control terminal is at the active level such that the fifth switching transistor is turned on, wherein, in the reset period, the second power supply voltage terminal is at a low voltage, and in the compensating period and the light emitting period, the second power supply voltage terminal is at a high voltage.

11. A driving method of the pixel circuit of claim 1, comprising:

during odd-numbered frames, under control of the first scanning signal at the first scanning control terminal, the first driving circuit reading a data signal at the data input terminal and driving the light emitting circuit to emit light according to the read data signal, and under control of the second scanning signal at the second scanning control terminal, the second driving circuit being reset and in a recovery stage;

during even-numbered frames, under control of the second scanning signal at the second scanning control terminal, the second driving circuit reading the data signal at the data input terminal and driving the light emitting circuit to emit light according to the read data signal, and under control of the first scanning signal at the first scanning control terminal, the first driving circuit being reset and in a recovery stage.

12. The driving method of claim 11, wherein during the odd-numbered frames, in the reset period, the first and the second scanning signals are at an active level, and the first and the second driving circuits are reset; in the compensating period, the first scanning signal is at the active level, the second scanning signal is at an inactive level, the first driving circuit performs a transistor threshold voltage compensation, and the second driving circuit remains in the reset state; in the data writing period, the first scanning signal is at the active level, the second scanning signal is at the inactive level, the first driving circuit reads the data signal at the data input terminal, and the second driving circuit remains in the reset state; and in the light emitting period, the first scanning signal is at the inactive level, the second scanning signal is at the inactive level, the first driving circuit drives the light emitting circuit to emit light, and the second driving circuit remains in the reset state;

during the even-numbered frames, in the reset period, the first and the second scanning signals are at the active level, and the first and the second driving circuits are reset; in the compensating period, the second scanning signal is at the active level, the first scanning signal is at the inactive level, the second driving circuit performs the transistor threshold voltage compensation, and the first driving circuit remains in the reset state; in the data writing period, the second scanning signal is at the active level, the first scanning signal is at the inactive level, the second driving circuit reads the data signal at the data input terminal, and the first driving circuit remains in the reset state; and in the light emitting period, the second scanning signal is at the inactive level, the first scanning signal is at the inactive level, the second driving circuit drives the light emitting circuit to emit light, and the first driving circuit remains in the reset state.

13. The driving method of claim 12, wherein the pixel circuit further comprises:

a writing control circuit, having a first terminal connected with a second power supply voltage terminal, a second terminal connected with a third power supply voltage terminal, a third terminal connected with a writing control terminal, a fourth terminal serving as the first driving voltage terminal, and a fifth terminal serving as the second driving voltage terminal.

14. The driving method of claim 13, wherein the second driving voltage terminal is the same as the first driving voltage terminal, the third power supply voltage terminal is the same as the second power supply voltage terminal;

wherein, in the reset period, the non-driving voltage is output at the first driving voltage terminal; in the data writing period, the first driving voltage terminal is floated and outputs no voltage; in the compensating period and the light emitting period, the first driving voltage terminal outputs the driving voltage.

15. The driving method of claim 13, wherein the second driving voltage terminal is different from the first driving voltage terminal, the third power supply voltage terminal is the same as or different from the second power supply voltage terminal;

wherein, during the odd-numbered frames, in the reset period, the first driving voltage terminal and the second driving voltage terminal output the non-driving voltage; in the data writing period, the first driving voltage terminal is floated and outputs no voltage; in the compensating period and the light emitting period, the first driving voltage terminal outputs the driving voltage; in the compensating period, the data writing period and the light emitting period, the second driving voltage terminal is floated or outputs the non-driving voltage;

during the even-numbered frames, in the reset period, the first driving voltage terminal and the second driving voltage terminal output the non-driving voltage; in the data writing period, the second driving voltage terminal is floated and outputs no voltage; in the compensating period and the light emitting period, the second driving voltage terminal outputs the driving voltage; in the compensating period, the data writing period and the light emitting period, the first driving voltage terminal is floated or outputs the non-driving voltage.

16. The driving method of claim 13, wherein the first driving circuit includes a first switching transistor, a first driving transistor and a first capacitor; a gate of the first switching transistor, as the third terminal of the first driving circuit, is connected with the first scanning control terminal, a first electrode of the first switching transistor, as the fourth terminal of the first driving circuit, is connected with the data input terminal, a second electrode of the first switching transistor is connected with a gate of the first driving transistor and a first terminal of the first capacitor; a first electrode of the first driving transistor, as the second terminal of the first driving circuit, is connected with the first driving voltage terminal, a second electrode of the first driving transistor, as the first terminal of the first driving circuit, is connected with the first terminal of the light emitting circuit and a second terminal of the first capacitor;

the second driving circuit includes a second switching transistor, a second driving transistor and a second capacitor; a gate of the second switching transistor, as the third terminal of the second driving circuit, is connected with the second scanning control terminal, a first electrode of the second switching transistor, as the fourth terminal of the second driving circuit, is connected with the data input terminal, a second electrode of the second switching transistor is connected with a gate of the second driving transistor and a first terminal of the second capacitor; a first electrode of the second driving transistor, as the second terminal of the second driving circuit, is connected with the second driving voltage terminal, a second electrode of the second driving transistor, as the first terminal of the second driving circuit, is connected with the first terminal of the light emitting circuit and a second terminal of the second capacitor.

17. The driving method of claim 16, wherein the first switching transistor, the first driving transistor, the second switching transistor and the second driving transistor are all N-type transistors, and the first electrode and the second electrode of each switching transistor are a drain and a source, respectively, the light emitting circuit includes an organic light emitting diode, an anode of the organic light emitting diode serves as the first terminal of the light emitting circuit, and a cathode of the organic light emitting diode serves as the second terminal of the light emitting circuit, wherein the non-driving voltage is a low voltage, the driving voltage is a high voltage; and the active level is a high level, the inactive level is a low level.

18. The driving method of claim 17, wherein during the odd-numbered frames, in the reset period, the first and the second switching transistors are turned on, the first and the second driving transistors are turned off, both of the first capacitor and the second capacitor are reset to the reset state, and the light emitting circuit emits no light; in the compensating period, the first switching transistor and the first driving transistor are turned on, the second switching transistor and the second driving transistor are turned off, the first capacitor stores a threshold voltage of the first driving transistor, the second capacitor remains in the reset state, and the light emitting circuit emits no light; in the data writing period, the first switching transistor and the first driving transistor are turned on, the second switching transistor and the second driving transistor are turned off, the first capacitor stores the threshold voltage of the first driving transistor and the data signal at the data input terminal, the second capacitor remains in the reset state, and the light emitting circuit emits no light; and in the light emitting period, the first switching transistor, the second switching transistor and the second driving transistor are turned off, the first capacitor maintains a voltage across its both terminals, the first driving transistor is turned on and drives the light emitting circuit to emit light, and the second capacitor remains in the reset state;

during the even-numbered frames, in the reset period, the first and the second switching transistors are turned on, the first and the second driving transistors are turned off, both of the first capacitor and the second capacitor are reset to the reset state, and the light emitting circuit emits no light; in the compensating period, the first switching transistor and the first driving transistor are turned off, the second switching transistor and the second driving transistor are turned on, the first capacitor remains in the reset state, the second capacitor stores a threshold voltage of the second driving transistor, and the light emitting circuit emits no light; in the data writing period, the first switching transistor and the first driving transistor are turned off, the second switching transistor and the second driving transistor are turned on, the first capacitor remains in the reset state, the second capacitor stores the threshold voltage of the second driving transistor and the data signal at the data input terminal, and the light emitting circuit emits no light; and in the light emitting period, the first switching transistor, the first driving transistor and the second switching transistor are turned off, the first capacitor remains in the reset state, the second capacitor maintains a voltage across its both terminals, and the second driving transistor is turned on and drives the light emitting circuit to emit light.

19. The driving method of claim 14, wherein the writing control circuit includes a fifth switching transistor, a gate of the fifth switching transistor, as the third terminal of the writing control circuit, is connected with the writing control terminal, a first terminal of the fifth switching transistor is connected with the second power supply voltage terminal, a second terminal of the fifth switching transistor serves as the first and the second driving voltage terminal, wherein, in the data writing period, a writing control signal at the writing control terminal is at the inactive level such that the fifth switching transistor is turned off, and in the other periods, the writing control signal at the writing control terminal is at the active level such that the fifth switching transistor is turned on, wherein, in the reset period, the second power supply voltage terminal is at a low voltage, and in the compensating period and the light emitting period, the second power supply voltage terminal is at a high voltage.

20. A display panel, comprising a pixel array, a gate driving circuit and a data driving circuit, each pixel in the pixel array including the pixel circuit of claim 1.

* * * * *